US008218787B2

(12) United States Patent
Kushida

(10) Patent No.: US 8,218,787 B2
(45) Date of Patent: Jul. 10, 2012

(54) MICROPHONE ARRAY SIGNAL PROCESSING APPARATUS, MICROPHONE ARRAY SIGNAL PROCESSING METHOD, AND MICROPHONE ARRAY SYSTEM

(75) Inventor: Koji Kushida, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 168 days.

(21) Appl. No.: 12/753,215

(22) Filed: Apr. 2, 2010

(65) Prior Publication Data

US 2010/0189279 A1 Jul. 29, 2010

Related U.S. Application Data

(62) Division of application No. 11/368,073, filed on Mar. 3, 2006, now abandoned.

(30) Foreign Application Priority Data

Mar. 3, 2005 (JP) ..... 2005-058785

(51) Int. Cl.
*H04R 3/00* (2006.01)

(52) U.S. Cl. ..... 381/92; 381/122

(58) Field of Classification Search ..... 381/92, 381/94.1, 94.3, 71.1, 26, 122, 91
See application file for complete search history.

(56) References Cited

U.S. PATENT DOCUMENTS

| | | | | |
|---|---|---|---|---|
| 5,960,373 | A | 9/1999 | Fukuda et al. | |
| 7,337,107 | B2 | 2/2008 | Rose et al. | |
| 7,529,660 | B2 | 5/2009 | Bessette et al. | |
| 2002/0176591 | A1 * | 11/2002 | Sandborn et al. | 381/118 |
| 2003/0179890 | A1 * | 9/2003 | Matsuo | 381/92 |
| 2005/0111674 | A1 * | 5/2005 | Hsu | 381/92 |
| 2006/0195316 | A1 | 8/2006 | Sakuraba | |
| 2006/0262944 | A1 * | 11/2006 | Rasmussen et al. | 381/110 |
| 2007/0053524 | A1 | 3/2007 | Haulick et al. | |
| 2007/0071116 | A1 | 3/2007 | Oshikiri | |
| 2007/0076898 | A1 * | 4/2007 | Sarroukh et al. | 381/92 |

FOREIGN PATENT DOCUMENTS

| | | |
|---|---|---|
| JP | 6202627 | 7/1994 |
| JP | 09-140000 | 5/1997 |
| JP | 2001-337694 | 12/2001 |
| JP | 2002-175099 | 6/2002 |

OTHER PUBLICATIONS

"Acoustic System and Digital Processing", Institute of Electronics, Information and Communication Engineers, Mar. 25, 1995, pp. 181-186.

* cited by examiner

*Primary Examiner* — Hai Phan
(74) *Attorney, Agent, or Firm* — Harness, Dickey & Pierce, PLC

(57) ABSTRACT

A microphone array signal processing apparatus which is capable of picking up sound in a low frequency band even with a compact microphone array. The microphone array signal processing apparatus is comprised of delay devices (411-1 to 411-M) that add delays to the respective ones of a plurality of sound signals output from the respective ones of a plurality of microphones constituting the microphone array, an adder (412) that sums the plurality of sound signals with the respective delays added thereto, a harmonic structure detecting section (421) that detects a harmonic structure of sound included in the sound signal, and a filtering processing section (422) that selectively passes predetermined frequency components based upon the detected harmonic structure.

6 Claims, 10 Drawing Sheets

MICROPHONE ARRAY SIGNAL PROCESSING APPARATUS, MICROPHONE ARRAY SIGNAL PROCESSING METHOD, AND MICROPHONE ARRAY SYSTEM

CROSS-REFERENCE TO RELATED APPLICATIONS

This application is a divisional of U.S. patent application Ser. No. 11/368,073 filed on Mar. 3, 2006. The entire disclosure of the above application is incorporated herein by reference.

BACKGROUND OF THE INVENTION

1. Field of the Invention

The present invention relates to a signal processing apparatus for a microphone array comprised of a plurality of microphones arranged in a given space, a signal processing method for the microphone array, and a microphone array system.

2. Description of the Related Art

Conventionally, array processing has been proposed in which delays are added to signals of sound received by a microphone array comprised of a plurality of microphones arranged in a given space, and then the signals are summed so that directivity is given to the microphone array (Japanese Laid-Open Patent Publication (Kokai) No. H09-140000, and "Acoustic System and Digital Processing" co-authored by Toshiro Oga, Yoshio Yamazaki, and Yutaka Kaneda, The Institute of Electronics, Information and Communication Engineers (issued on Mar. 25, 1995), see Pages 181 to 186). Such array processing is referred to as "delay-and-sum processing" or "DS (Delay-and-Sum) processing."

The principle of the DS processing will be summarized below.

In general, a microphone array system is comprised of a microphone array of M (M is a positive integer not less than 2) microphones MICi (i is a positive integer from 1 to M), delay devices that give delays Di to audio signals xsi(t) output from the respective microphones, and an adder that sums the delayed sound signals xsi(t−Di). For simplicity, it is assumed that the microphone array working as sound receivers is implemented by an equally-spaced linear microphone array comprised of M microphones arranged at regular intervals in a line.

By giving suitable delays Di to sound signals xsi(t) output from the respective microphones, it is possible to correct for the time lags between sounds reaching the respective microphones from the intended direction θL (the direction in which the microphone array is desired to have directivity) so that the sounds can be in phase. On the other hand, sounds reaching the respective microphones from directions other than the intended direction θL cannot be in phase by the above delay processing. Thus, when the delayed sound signals xsi(t−Di) are summed, the signals being in phase are emphasized, but the signals not being in phase are not so emphasized. As a result, the microphone array has such a directional characteristic as to be highly sensitive to sound coming from the intended direction θL.

According to the above-mentioned "Acoustic System and Digital Processing", the directional characteristic of the microphone array system obtained by the above described DS processing can be expressed as below. First, the amplitude ratio of the array processing output y(t) and the array input xi(t), i.e. the array gain G can be expressed by the following equations (1) and (2):

$$G=|\sin(\Omega M/2)/\sin(\Omega M/2)| \quad (1)$$

$$\text{where } \Omega=2\pi fd(\sin\theta L-\sin\theta)/c \quad (2)$$

f: Frequency of the sound signal d: Distance between microphones

θL: Intended direction

θ: Direction from which sound comes c: Sound velocity

The directional characteristic of the microphone array system before the array gain G becomes zero (or a sufficiently low gain) is referred to as a mainlobe; the array gain G becomes zero for the first time on the condition that the following equation (3) using the above equation (1) is satisfied:

$$\Omega M/2=\pi \quad (3)$$

When θL=0, the angle θ1 (mainlobe width) at which the array gain G becomes zero for the first time is expressed by the following equation (4) using the above equations (2) and (3):

$$\theta 1=\sin^{-1}(c/fdM) \quad (4)$$

As is evident from the above equation (4), the mainlobe width decreases as the frequency f, the distance between microphones d, and the number of microphones M increase.

According to the above-mentioned "Acoustic System and Digital Processing", the microphone array system has the following properties regarding the directional characteristic, which apply to array types other than linear arrays:

(1) When large values are selected as the number of microphones M and the distance between microphones d, and the array length Md is set to be long, a sharp directional characteristic in the intended direction can be realized.

(2) The mainlobe width depends on the frequency (i.e., the higher the frequency, the sharper the directional characteristic).

(3) When the distance between microphones d is less than c/2f, no spatial loopback of the mainlobe occurs.

It should be noted that the applicant has found no prior art related to the present invention except for Laid-Open Patent Publication (Kokai) Nos. H09-140000, H06-202627, and H09-251044 (corresponding to U.S. Pat. No. 5,960,373) as well as the above-mentioned "Acoustic System and Digital Processing".

The array length of the microphone array as a whole must be long so as to obtain a sharp directional characteristic for a low frequency band due to the above described properties of the DS microphone array system, and this has been a hindrance to the downsizing of the microphone array. Also, when a compact microphone array is used, a satisfactorily sharp directional characteristic cannot be realized, and hence there is the problem that sound signals in a low frequency band are buried in other sound signals (noise) coming from the surroundings.

SUMMARY OF THE INVENTION

It is an object of the present invention to provide a microphone array signal processing apparatus and a microphone array signal processing method, which are capable of picking up sound in a low frequency band even with a compact microphone array, as well as a microphone array system.

To attain the above object, in a first aspect of the present invention, there is provided a microphone array signal processing apparatus comprising delay devices that add delays to respective ones of a plurality of sound signals output from respective ones of a plurality of microphones constituting a microphone array, an adder that sums the plurality of sound signals with the respective delays added thereto, a detecting device that detects a harmonic structure of sound included in the sound signal, and a filter device that selectively passes predetermined frequency components based upon the detected harmonic structure.

With this arrangement, with respect to sufficiently high frequency components, a desired directional characteristic is obtained by the delay-and-sum processing performed by the delay devices and the adder, and on the other hand, among low frequency components, frequency components irrelevant to the concerned sound signal are removed by the filter device based upon the harmonic structure of the sound signal, since the directional characteristic of the microphone array depends on the array length and the frequency.

Thus, selectivity can be enhanced with respect to even low frequency components for which a sharp directional characteristic has not been realized according to the prior art, and therefore noise can be suppressed. As a result, it is possible to pick up sound in a low frequency band without making the array length long.

Preferably, the detecting device comprises an extracting section that extracts a fundamental pitch included in the sound signal, and the filter device selectively passes components of frequencies that are integral multiples of the extracted fundamental pitch in the sound signal output from the adder.

Preferably, the detecting device identifies a harmonic structure of a sound signal coming from one sound source based upon temporal changes in spectrums of the sound signals.

Preferably, the filter device comprises a high-pass filter that passes high frequency components of an output from the adder, a comb filter that passes predetermined frequency components based upon the harmonic structure, and an output device that sums an output from the high-pass filter and an output from the comb filter and outputs an adding result.

Preferably, the microphone array signal processing apparatus is further comprised of a determining device that determines a direction of a sound source, and the filter device selectively passes predetermined frequency components based upon a harmonic structure of a sound signal coming from the sound source in the direction determined by the determining devise.

More preferably, the determining device determines the direction of the sound source based upon the harmonic structure of the sound signal and frequency response obtained by delay-and-sum processing performed by the delay devices and the adder.

With this arrangement, for example, if the harmonic structure spectrums of a sound signal from the concerned sound source before and after the delay-and-sum processing are compared, they exhibit substantially the same tendency when a sound source lies in the intended direction (the center of the directional pattern of the microphone array), and on the other hand, they exhibit different tendencies when a sound source does not lie in the intended direction. Thus, the direction of a sound source can be determined by comparing the spectrums before and after the delay-and-sum processing with respect to each harmonic structure.

To attain the above object, in a second aspect of the present invention, there is provided a microphone array signal processing apparatus comprising delay devices that adds delays to respective ones of a plurality of sound signals output from respective ones of a plurality of microphones constituting a microphone array, an adder that sums the plurality of sound signals with the respective delays added thereto, a detecting device that detects a harmonic structure of sound included in the sound signal, and a determining device that determines a direction of a sound source based upon the harmonic structure of the sound signal and frequency response obtained by delay-and-sum processing performed by the delay devices and the adder.

With the above arrangement, the same effects as those in the first aspect can be obtained.

To attain the above object, in a third aspect of the present invention, there is provided a microphone array signal processing method comprising a delay step of adding delays to respective ones of a plurality of sound signals output from respective ones of a plurality of microphones constituting a microphone array, an adding step of summing the plurality of sound signals with the respective delays added thereto, a detecting step of detecting a harmonic structure of sound included in the sound signal, and a filtering step of selectively passing predetermined frequency components based upon the detected harmonic structure.

To attain the above object, in a fourth aspect of the present invention, there is provided a microphone array signal processing method comprising a delay step of adding delays to respective ones of a plurality of sound signals output from respective ones of a plurality of microphones constituting a microphone array, an adding step of summing the plurality of sound signals with the respective delays added thereto, a detecting step of detecting a harmonic structure of sound included in the sound signal, and a determining step of determining a direction of a sound source based upon the harmonic structure of the sound signal and frequency response obtained by delay-and-sum processing performed in the delay step and the adding step.

To attain the above object, in a fifth aspect of the present invention, there is provided a microphone array system comprising a microphone array comprising a plurality of spatially-arranged microphones, and a microphone array signal processing apparatus comprising delay devices that add delays to respective ones of a plurality of sound signals output from respective ones of the plurality of microphones constituting the microphone array, an adder that sums the plurality of sound signals with the respective delays added thereto, a detecting device that detects a harmonic structure of sound included in the sound signal, and a filter device that selectively passes predetermined frequency components based upon the detected harmonic structure.

To attain the above object, in a sixth aspect of the present invention, there is provided a microphone array system comprising a microphone array comprising a plurality of spatially-arranged microphones, and a microphone array signal processing apparatus comprising delay devices that adds delays to respective ones of a plurality of sound signals output from respective ones of the plurality of microphones constituting the microphone array, an adder that sums the plurality of sound signals with the respective delays added thereto, a detecting device that detects a harmonic structure of sound included in the sound signal, and a determining device that determines a direction of a sound source based upon the harmonic structure of the sound signal and frequency response obtained by delay-and-sum processing performed by the delay devices and the adder.

The above and other objects, features, and advantages of the invention will become more apparent from the following detained description taken in conjunction with the accompanying drawings.

DETAILED DESCRIPTION OF THE PREFERRED EMBODIMENTS

Figure 1:
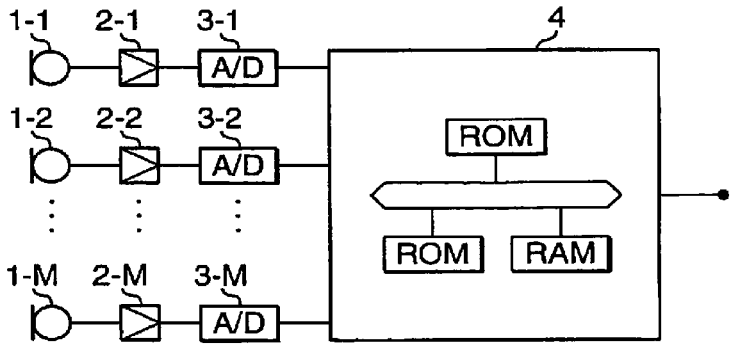
FIG. 1 is a diagram showing the general outline of a microphone array system according to a first embodiment of the present invention.

The present invention will now be described in detail with reference to the drawings showing preferred embodiments thereof. In the drawings, elements and parts which are identical throughout the views are designated by identical reference numerals and duplicate description thereof is omitted.

Figure 2:
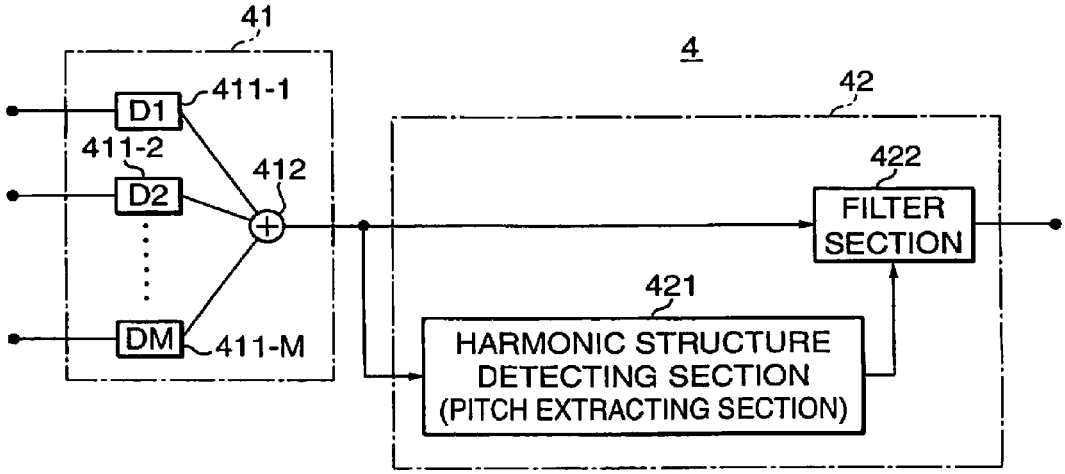
FIG. 2 is a diagram showing the construction of a signal processing apparatus in the microphone array system.

FIG. 1 is a diagram showing the general outline of a microphone array system according to a first embodiment of the present invention, and FIG. 2 is a diagram showing the construction of a signal processing apparatus in the microphone array system.

As shown in FIG. 1, the microphone array system according to the first embodiment is comprised of M microphones 1-1 to 1-M constituting a microphone array, amplifiers 2-1 to 2-M that amplify sound signals output from the respective microphones, A/D converters 3-1 to 3-M that carry out digital-to-analog (A/D) conversion of the amplified sound signals, and a signal processing apparatus 4 that performs digital signal processing on the A/D-converted sound signals and outputs them.

It should be noted that the signal processing apparatus 4 may be realized by a computer having a CPU (central processing unit) and storage devices such as a ROM which stores programs for controlling the signal processing apparatus 4 and a RAM which stores the results of various computations performed by the CPU. A dedicated signal processor (DSP) may be used in place of a general-purpose CPU.

As shown in FIG. 2, the signal processing apparatus 4 is comprised of a delay-and-sum (DS) processing section 41 and a filtering processing section 42.

The DS processing section 41 is comprised of delay devices 411-1 to 411-M that add delays to the respective A/D-converted sound signals, and an adder 412 that sums the outputs from the delay devices 411-1 to 411-M. The DS processing section 41 is identical in basic construction and operation with the conventional DS processing section.

The filtering processing section 42 is a filter that performs filtering based upon the harmonic structures of the sound signal after the DS processing, which is output from the DS processing section 41. The filtering processing section 41 is comprised mainly of a harmonic structure detecting section (pitch extracting section) 421 and a filter section 422. The pitch extracting section 421 extracts the fundamental pitch from the sound signal after the DS processing, which is output from the DS processing section 41, using a known pitch extracting method. Refer to Japanese Laid-Open Patent Publication (Kokai) Nos. H06-202627 and H09-251044 for description on the known pitch extracting method.

On the other hand, the filter section 422 functions as a kind of comb filter that passes only components of frequencies in a low frequency band that are integral multiples of the fundamental pitch extracted by the pitch extracting section 421 and functions as a digital filter that passes components of higher frequencies as they are. The frequency band for which the filter section 422 should function as the comb filter may be a frequency band in which a satisfactory directional characteristic cannot be obtained by the DS processing. Such a frequency band may be determined in dependence on the array length of the microphone array.

In the conventional microphone array system, when the array length of the microphone array cannot be long enough, a satisfactorily sharp directional characteristic cannot be obtained by the DS processing with respect to a low frequency band. For this reason, in many cases, the sound signal after the DS processing, which is output from the DS processing section 41, includes broadband noise such as air-conditioning noise and projector noise as well as sound desired to be picked up.

On the other hand, sound desired to be picked up generally has a harmonic structure comprised of the fundamental pitch (fundamental frequency) and harmonic components which are integral multiples of the fundamental pitch. Accordingly, in the present embodiment, first, the pitch extracting section 421 extracts the fundamental pitch (fundamental frequency) of the sound signal after the DS processing, which is output from the DS processing section 41, and the filter section 422 finds the integral multiples of the fundamental pitch to detect the harmonic structure. By performing filtering based upon the detected harmonic structure, the filter section 422 can remove broadband noise.

Next, a description will be given of the construction of the above-described filter section 422 with reference to FIG. 3.

Figure 3:
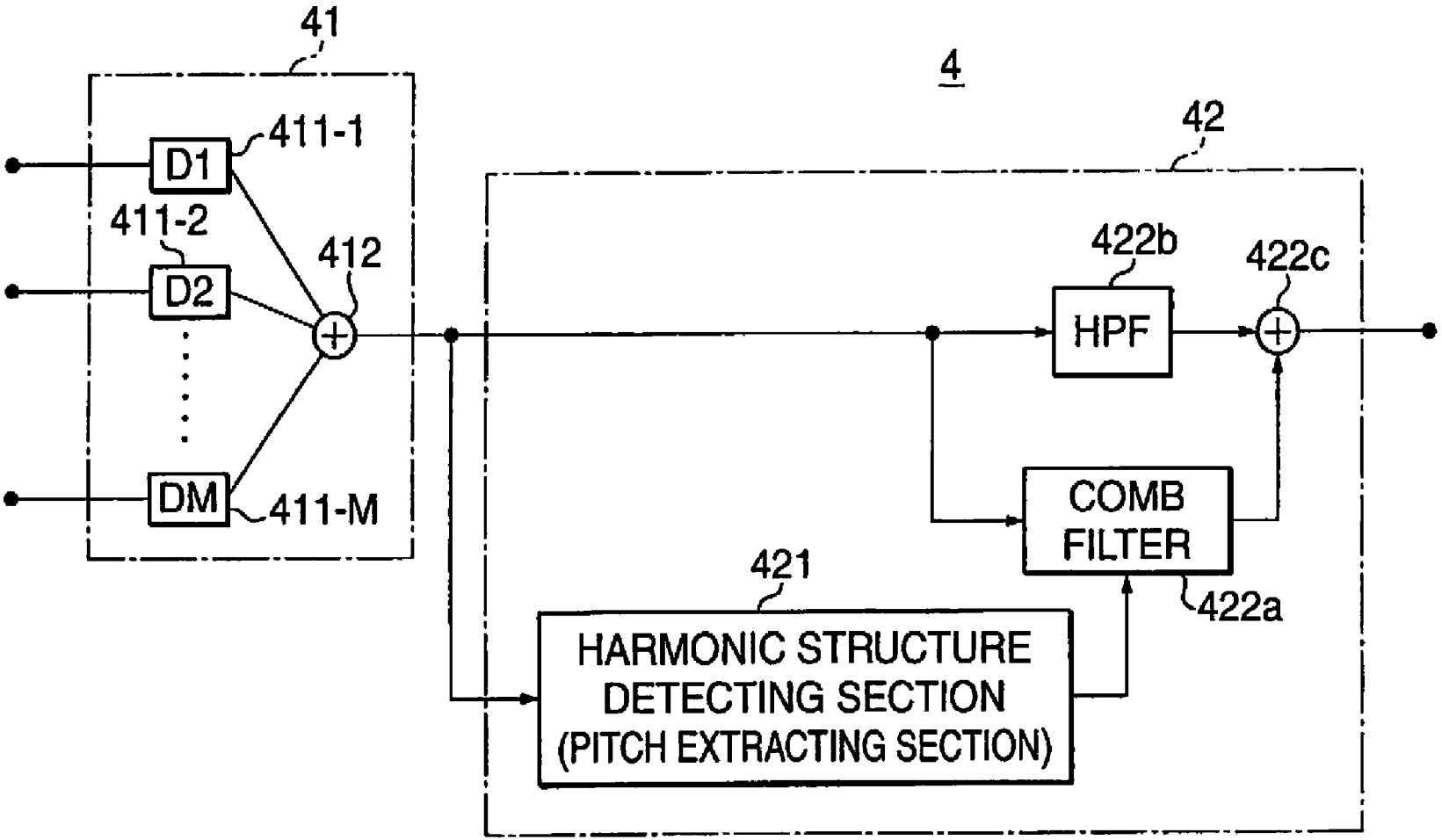
FIG. 3 is a diagram showing the construction of the signal processing apparatus in the microphone array system.

As shown in FIG. 3, the filtering processing section 42 of the signal processing apparatus 4 is comprised of the pitch extracting section 421, a comb filter 422*a*, a high-pass filter (HPF) 422*b* that extracts components of high frequencies from the output from the DS processing section 41, and an adder 422*c* that sums the output from the comb filter 422*a* and the output from the HPF 422*b*.

The comb filter 422*a* is configured to pass components of frequencies that are integral multiples of the fundamental pitch extracted by the pitch extracting section 421. Thus, among only harmonic structure components of the sound signal output from the DS processing section 41 are output from the comb filter 422*a*. The comb filter 422*a* configured in this manner may be implemented by a digital filter or may be implemented in frequency domains.

On the other hand, the HPF 422*b* is configured to pass only signal components in a high frequency band in which a satisfactory directional characteristic can be obtained by the DS processing. Thus, the low frequency components including broadband noise of the sound signal output from the DS processing section 41 are cut by the HPF 422*b*, so that only signal components in a high frequency band in which a satisfactory directional characteristic can be obtained are output.

With the above construction, the microphone array system according to the present embodiment performs only the DS processing on high frequency components and performs filtering based upon the harmonic structure on signal components in a low frequency band in which a sharp directional characteristic cannot be obtained by the DS processing.

In particular, high frequency components of the output from the DS processing section 41 are supplied by the HPF 422*b* so that the loss of a sound signal such as a voiceless consonant with its primary energy distributed in a relatively high frequency band can be avoided.

Figure 4:
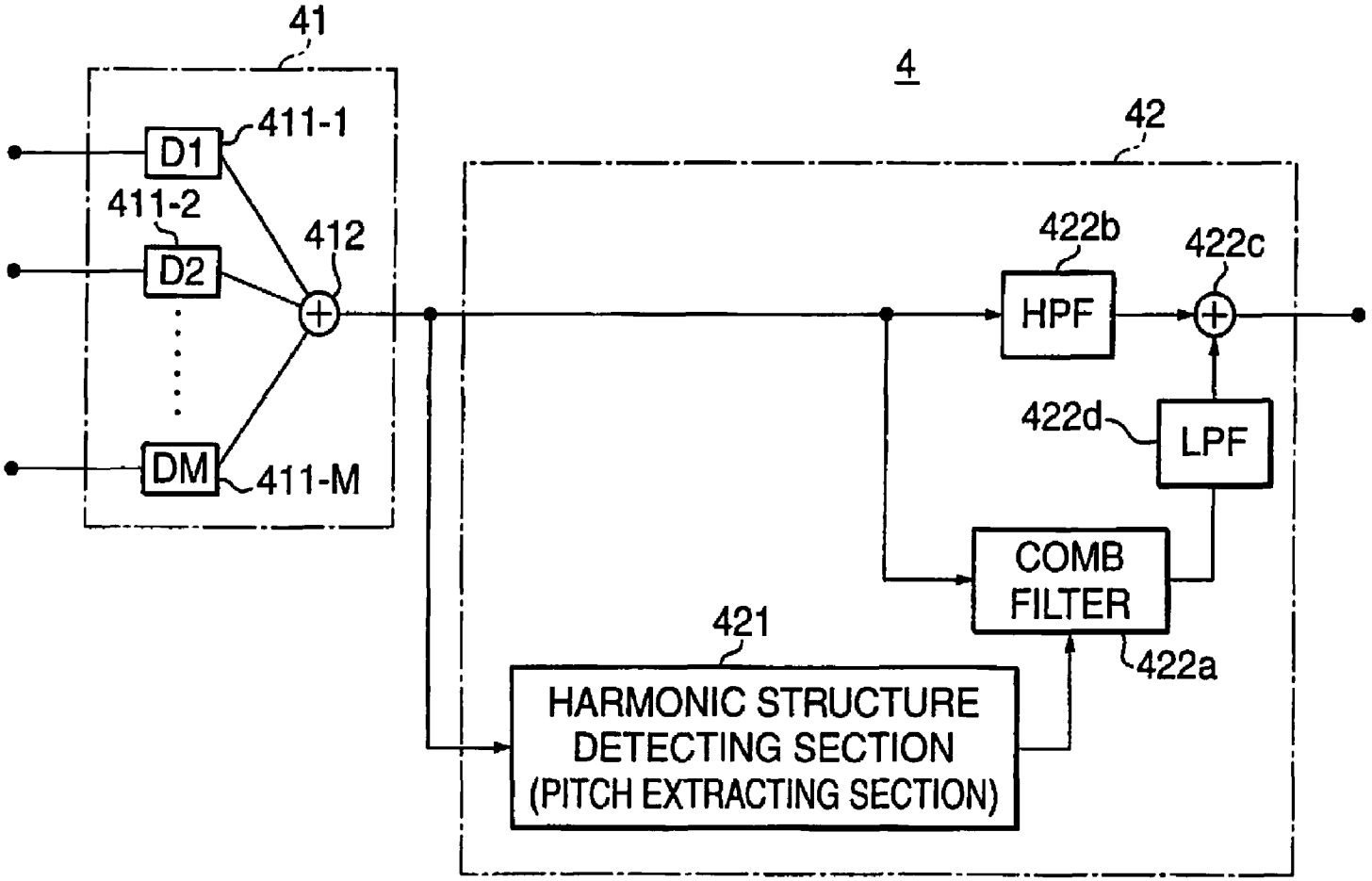
FIG. 4 is a diagram showing a variation of the construction of the signal processing apparatus in the microphone array system.

In a variation of the present embodiment, as shown in FIG. 4, a low-pass filter (LPF) 422*d* may be provided in a stage subsequent to the comb filter 422*a*, and the outputs from the comb filter 422*a* may be supplied to the adder 422*c* via the LPF 422*d*. Such an LPF 422*d* may be provided in a stage preceding the comb filter 422*a*. In this case, it is preferred that a band of frequencies passing through the LPF 422*d* is a low frequency band in which a satisfactory directional characteristic cannot be obtained by the DS processing so that the LPF 422*d* and the HPF 422*b* are complementary to each other. As a result, degradation of sound quality can be suppressed.

Figure 5:
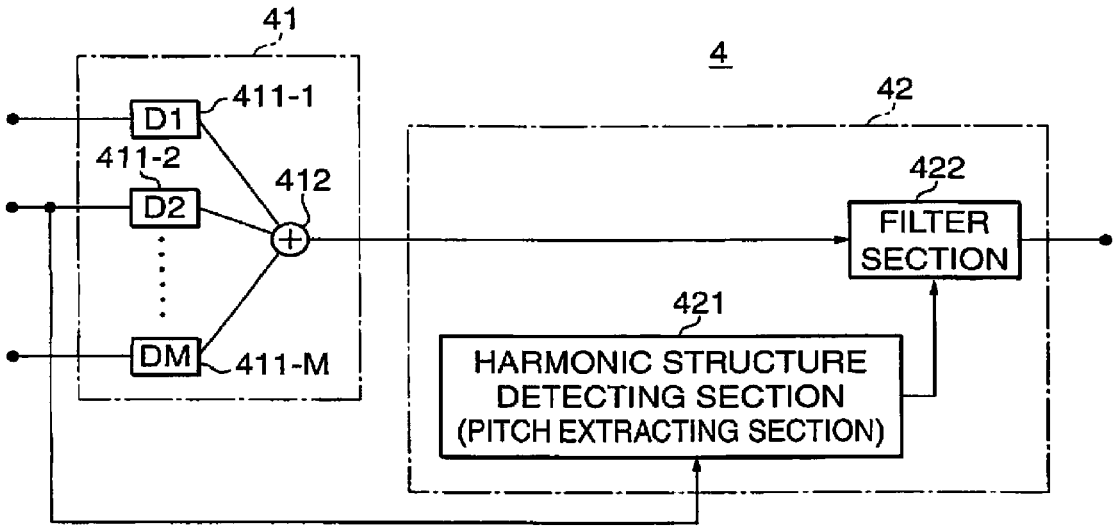
FIG. 5 is a diagram showing the construction of a signal processing apparatus in a microphone array system according to a second embodiment of the present invention.

Referring next to FIG. 5, a description will be given of a second embodiment of the present invention.

In the above described first embodiment, the output from the DS processing section 41 is input to the pitch extracting section 421, so that the fundamental pitch is extracted from the sound signal after the DS processing, but in the second embodiment, the fundamental pitch is extracted from a sound signal before the DS processing.

FIG. 5 is a diagram showing the construction of a signal processing apparatus 4 in a microphone array system according to the second embodiment. As shown in FIG. 5, a pitch extracting section 421 may extract the fundamental pitch from an A/D-converted sound signal from a given microphone selected from among M microphones constituting a microphone array. Alternatively, an additional microphone, not shown, from which the fundamental pitch is to be extracted may be provided separately from the microphone array.

It should be noted that in the present embodiment, the microphone array system except for the signal processing apparatus 4 is identical in arrangement with that of the above described first embodiment (see FIG. 1). Also, the component elements of the signal processing apparatus 4 are identical with those of the first embodiment.

Referring next to FIGS. 6 to 9, a description will be given of a third embodiment of the present invention. It should be noted that elements and parts corresponding to those of the prior art and the first embodiment described above are denoted by the same reference numerals, and description thereof is omitted where appropriate.

A microphone array system according to the third embodiment is comprised of a means for, even in the case where a microphone array detects sounds from a plurality of sound sources due to an unsatisfactorily sharp directional characteristic, determining the direction of a sound source based upon directions in which the sounds from the plurality of sound sources are coming.

Figure 6:
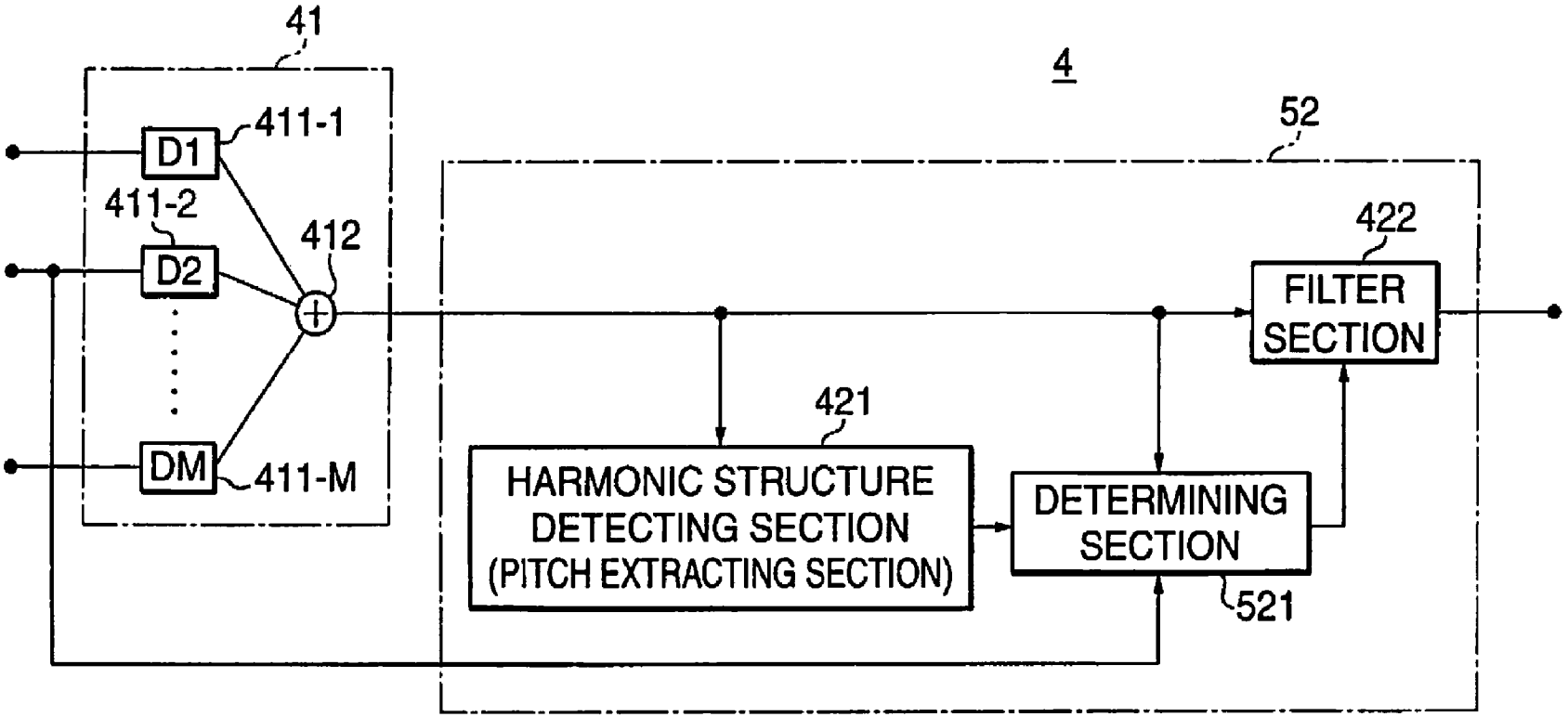
FIG. 6 is a diagram showing the construction of a signal processing apparatus in a microphone array system according to a third embodiment of the present invention.

FIG. 6 is a diagram showing the construction of a signal processing apparatus 4 in the microphone array system according to the present embodiment. In the present embodiment, the signal processing apparatus 4 is comprised of a pitch extracting section 421, a determining section 521, and a filter section 422.

As is the case with the above described first embodiment, the pitch extracting section 421 extracts the fundamental pitch from a sound signal (in the present embodiment, an output signal from the DS processing section 41).

The determining section 521 compares the signal before the DS processing and the signal after the DS processing with respect to each harmonic structure obtained from the fundamental pitch extracted by the pitch extracting section 421, determines whether or not the concerned sound having the fundamental pitch has come from the intended direction (θL), and outputs the fundamental pitch of the sound that has come from the intended direction (θL) to the filter section 422. The principle based upon which the direction of a sound source is determined will be described later.

The filter section 422 functions as a kind of comb filter that passes only components of frequencies in a low frequency band that are integral multiples of the fundamental pitch given by the determining section 521 and functions as a digital filter that passes components of higher frequencies as they are. The characteristics of the filter section 422 are the same as those of the filter section 422 according to the first embodiment.

Referring next to FIGS. 7A to 9, a description will be given of how the direction of a sound source is determined by the determining section 521.

Figure 7A:
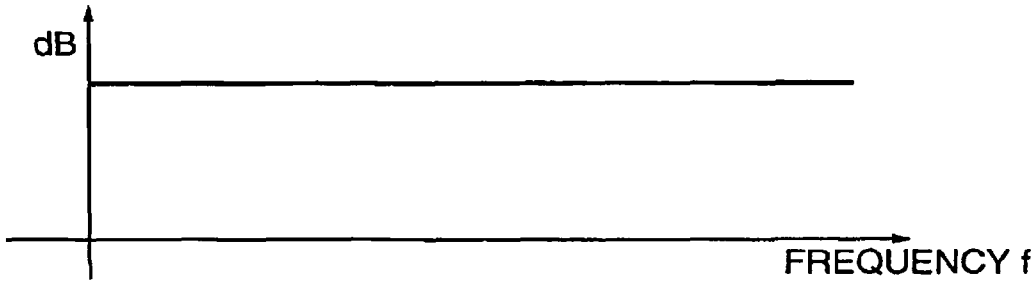
FIG. 7A is a diagram showing the frequency response of a sound signal after the DS processing (where a sound source lies in the intended direction θL)
Figure 7B:
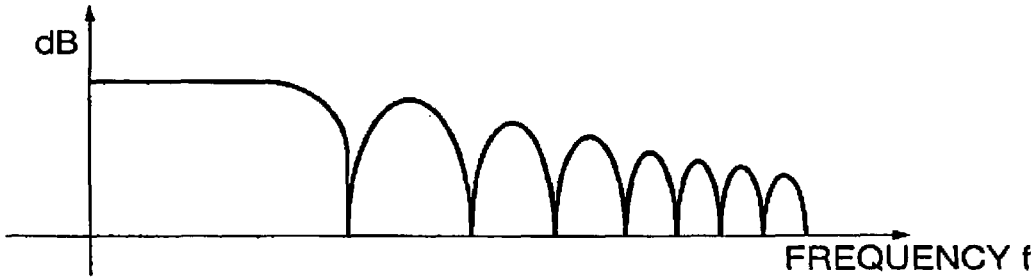
FIG. 7B is a diagram showing the frequency response of a sound signal after the DS processing (where a sound source does not lie in the intended direction θL)

(1) The Direction of a Sound Source and the Frequency Response Obtained by the DS Processing The intended direction θL of the microphone array can be determined by suitably controlling each delay Di in the DS processing. The directional characteristic of the microphone array depends on the frequency as described above (see the equations (1) to (4), for example). FIGS. 7A and 7B show the frequency response of a sound signal after the DS processing, in which FIG. 7A shows the case where a sound source lies in the intended direction θL, and FIG. 7B shows the case where a sound source does not lie in the intended direction θL. When a sound source lies in the intended direction θL, the frequency response is substantially flat over the entire frequency range (FIG. 7A). On the other hand, when a sound source does not lie in the intended direction θL, frequency response is flat in a low frequency range, although a plurality of specific frequencies (such frequencies vary according to the number of microphones M, the distance between microphones d, and the deviation θ with respect to the intended direction of a sound source) tend to peak in a high frequency band, and the gains tend to be small as a whole in a low frequency range due to the dependence of directional characteristic on frequency (FIG. 7B).

Thus, when the signal before the DS processing and the signal after DS processing are compared with each other in the frequency range with respect to sound coming from a given sound source, their signal levels are substantially equal at peak frequencies constituting the harmonic structure when the sound source lies in the intended direction θL, and on the other hand, their signal levels vary with peak frequencies when the sound source does not lie in the intended direction θL.

(2) The Determination of the Direction of a Sound Source Based Upon the Harmonic Structure In the real environment, a plurality of signals from various sound sources are mixed, and hence merely by comparing the signal before the DS processing and the signal after the DS processing, it is almost impossible to find differences in frequency response as described above with respect to a specific sound source.

Accordingly, in the present embodiment, focusing on the fact that each sound source has a specific harmonic structure, the signal before the DS processing and the signal after DS processing are compared with each other only with respect to positions of overtones constituting one harmonic structure. Thus, if their overtone elements are emitted from the same sound source, frequency components thereof exhibit the frequency response of the DS processing. It is therefore possible to determine directions of a plurality of sound sources by comparing the frequency responses obtained by the DS processing with respect to respective harmonic structures.

A description will now be given of how a direction of a sound source is determined based upon harmonic structures with reference to FIGS. 8 and 9.

Figure 8:
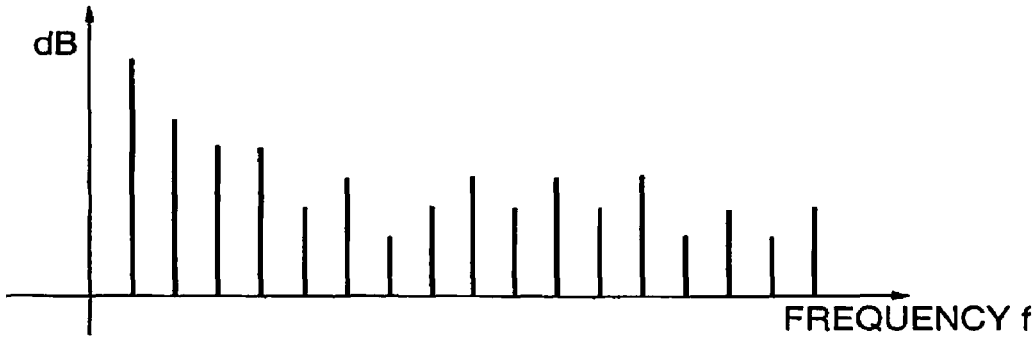
FIG. 8 is a diagram showing an example of the Fourier spectrum of sound.

FIG. 8 is a diagram showing an example of the Fourier spectrum of sound from a specific sound source. The horizontal axis indicates the frequency, and the vertical axis indicates the intensity. As shown in FIG. 8, since sound existing in the natural world generally has a harmonic structure, the Fourier spectrum has peaks at regular intervals at frequencies that are integral multiples of the fundamental pitch (characteristic frequency).

Figure 9A:
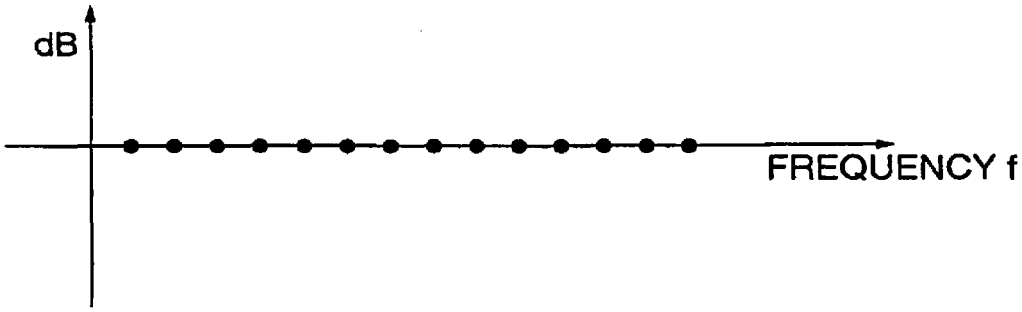
FIG. 9A is a diagram showing differences between a sound signal before the DS processing and the sound signal after the DS processing with respect to overtone components constituting a harmonic structure shown in FIG. 8 (where a sound source lies in the intended direction θL)
Figure 9B:
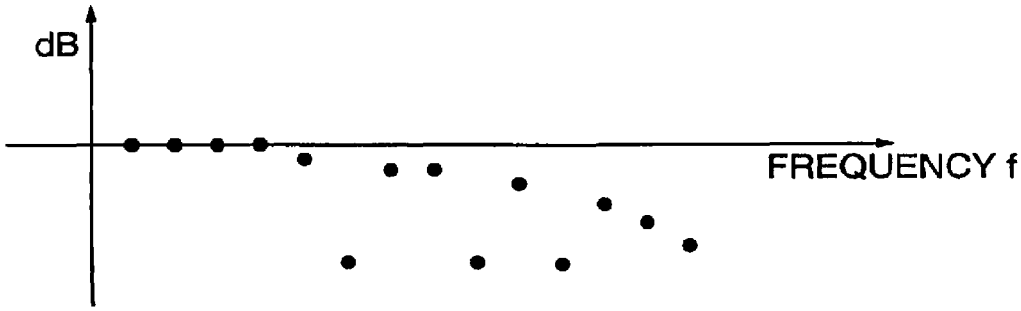
FIG. 9B is a diagram showing the differences between a sound signal before the DS processing and the sound signal after the DS processing with respect to overtone components constituting a harmonic structure shown in FIG. 8 (where a sound source does not lie in the intended direction θL)

FIGS. 9A and 9B are diagrams showing differences between the sound signal before the DS processing and the sound signal after the DS processing with respect to overtone components constituting the harmonic structure shown in FIG. 8. FIG. 9A shows an example of the envelope in the case where a sound source lies in the intended direction θL, and FIG. 9B shows an example of the envelope in the case where a sound source does not lie in the intended direction θL. In the former case, the differences are substantially the same (that is, flat) with respect to all the overtone components, whereas in the latter case, the differences vary particularly in a high frequency range.

Thus, by finding the frequency response obtained by the DS processing with respect to each of harmonic structures varying in fundamental pitch, it is possible to determine whether or not a sound source having the harmonic structure lies in the intended direction θL based upon the frequency response.

As described above, in the present embodiment, the determining section 521 determines the direction of a desired sound source based upon the harmonic structures, so that only the harmonic structure of a sound source lying in the intended direction θL can be supplied to the filter section 422. As a result, even in a low frequency band, it is possible to pick up a sound signal coming from the intended direction θL among sound signals coming from a plurality of sound sources picked up by the microphone array.

Although in the present embodiment, the determining section 521 carries out the determination based upon the signal after one DS processing with the intended direction being θL, another DS processing with a different intended direction may be carried out at the same time, and the same determination may be carried out with respect to the signal after this DS processing. In this case, it is obvious that when a sound source lies in the intended direction θL, the envelope based upon the frequency response after the DS processing with the different intended direction is not flat. Thus, determination accuracy can be improved by acquiring two or more envelopes with different intended directions and actively using information indicative of the envelope being not flat.

Further, in the present embodiment, as a method to identify the harmonic structure with respect to each sound source from signals of mixed sounds from a plurality of sound sources, the pitch extracting section 421 may extract the fundamental pitch from each sound signal using the known pitch extracting method, but alternatively, the harmonic structure of sound coming from one sound source may be identified based upon temporal changes in the spectrums of sound signals.

Figure 10:
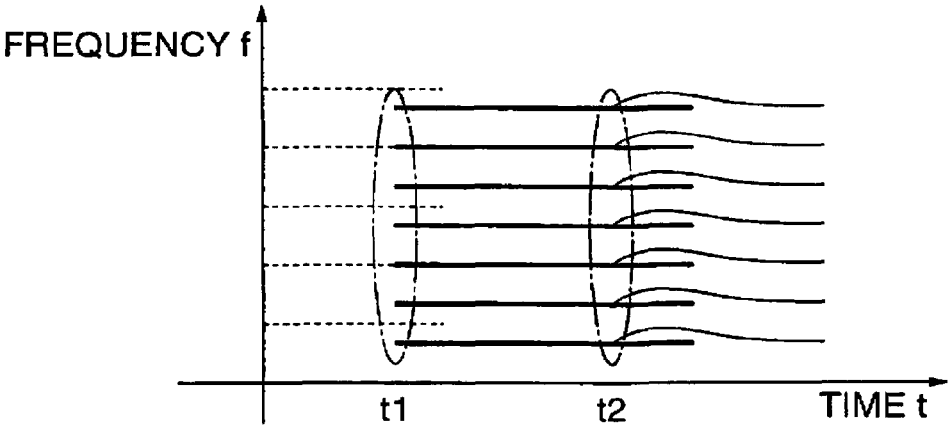
FIG. 10 is a diagram showing an example of temporal changes in the spectrums of sound signals.

FIG. 10 is a diagram showing an example of temporal changes in the spectrums of sound signals. The vertical axis indicates the frequency, and the horizontal axis indicates the time. FIG. 10 shows the state in which the frequency spectrums of sounds from different sound sources (for example, a speaker A and a speaker B) as well as their harmonic structures appear at different times. In the illustrated example, the speaker A starts speaking at a time t1, and then the speaker B starts speaking at a time t2. In this manner, the harmonic structure detector 421 may identify the harmonic structures of sounds with respect to each sound source based upon temporal changes in the spectrums of sound signals, e.g., the occurrence of the spectrums indicative of the harmonic structures and the timing of peaks thereof.

Figure 11:
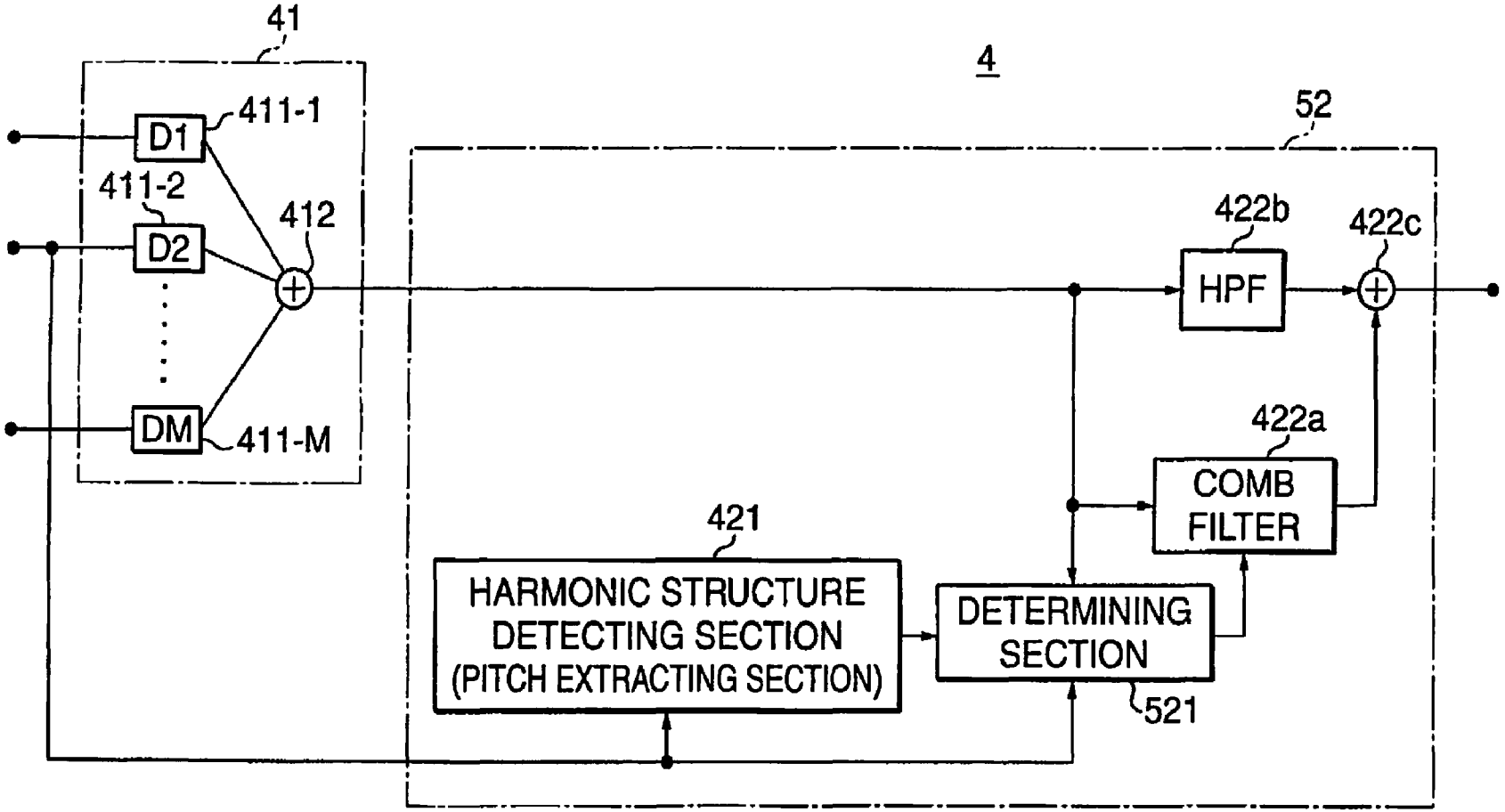
FIG. 11 is a diagram showing a variation of the construction of a signal processing apparatus in a microphone array system according to the third embodiment.

In a variation of the present embodiment, as shown in FIG. 11, the pitch extracting section 421 may extract the fundamental pitch from the signal before the DS processing. Also, a comb filter 422*a* may be provided in place of the filter section 422, and the output from the comb filter 422*a* and the output from the HPF 422 may be summed.

Figure 12:
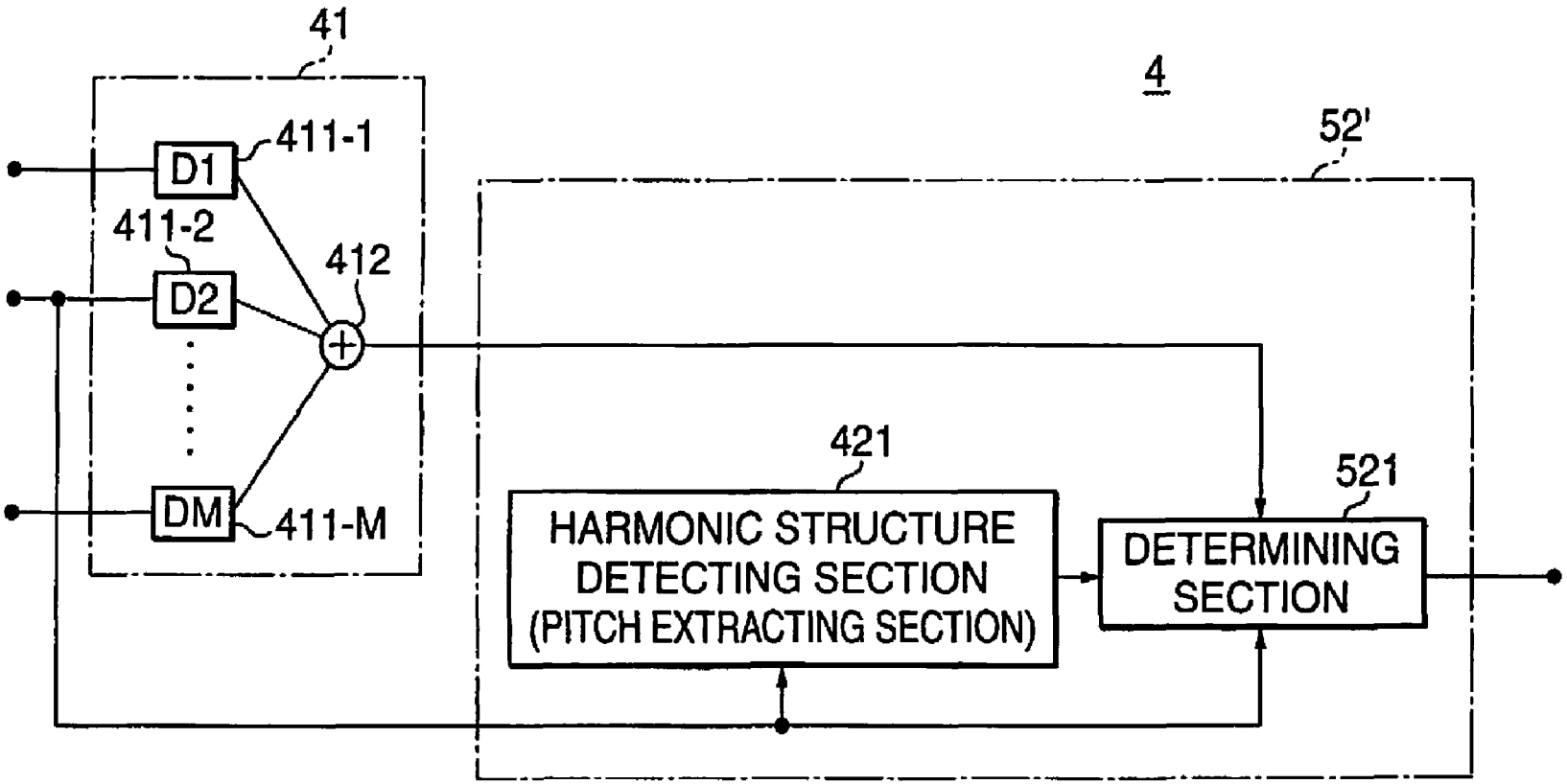
FIG. 12 is a diagram showing the construction of a signal processing apparatus in a microphone array system according to a fourth embodiment of the present invention.
Figure 13:
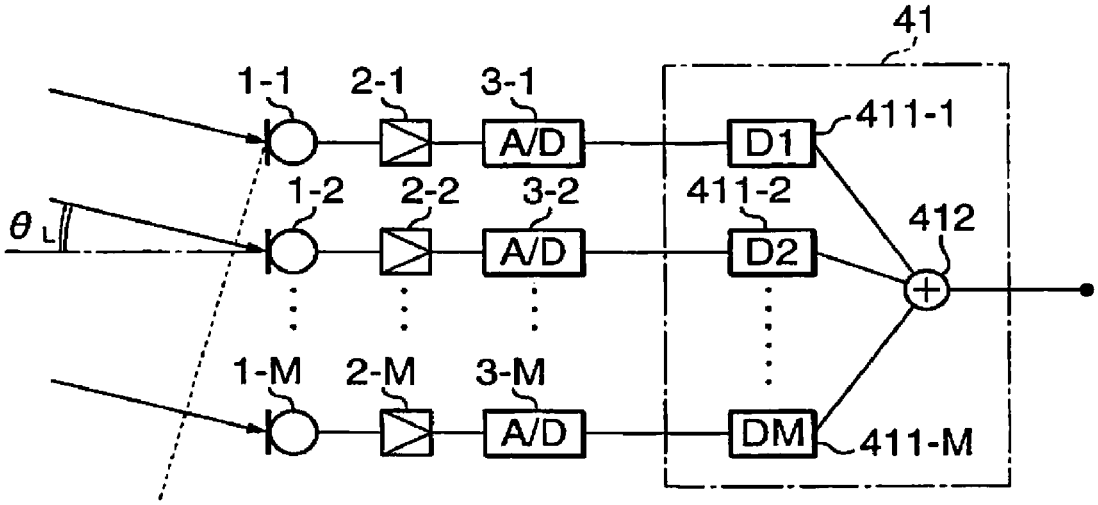
FIG. 13 PRIOR ART
FIG. 13 is a view useful in explaining a conventional microphone array system.

FIG. 12 is a diagram showing the construction of a signal processing apparatus according to a fourth embodiment of the present invention. This signal processing apparatus is configured as a sound source direction determining device, in which a filtering processing section 52' comprised of the harmonic structure detecting section (pitch extracting section) 421 and the determining section 521 with the filter section 422*a* and the HPF 422*b* omitted from the filtering processing section 52 of the signal processing apparatus 4 in FIG. 11 is combined with the DS processing section 41.

In this sound source direction determining device, the signal before the DS processing and the signal after the DS processing are compared with each other with respect to each harmonic structure obtained from the fundamental pitch extracted by the harmonic structure extracting section 421, and it is determined whether or not the concerned sound having the fundamental pitch has come from the intended direction (θL). Thus, even when a plurality of persons are speaking, if sounds emitted by them have different harmonic structures, it is possible to identify the direction in which each speaker lies. On this occasion, the current intended direction (θL) may be calculated based upon the delays D1 to DM added by the DS processing section 41 and output, although this is not illustrated.

Further, in the present embodiment, the harmonic structure of a sound signal picked up by microphones is identified using the harmonic structure detecting section 421, but in a variation of the present embodiment, a storage means such as a memory may be provided to store the harmonic structure of a desired sound source, and the direction of a desired sound source can be identified by changing the directional characteristic of the microphone array.

Further, if it is determined whether or not a sound source lies at the front of the microphone array, the delay sections 411-1 to 411-M of the DS processing section 41 become unnecessary.

What is claimed is:

1. A microphone array signal processing apparatus comprising:

delay devices that add delays to respective ones of a plurality of sound signals output from respective ones of a plurality of microphones constituting a microphone array;

an adder that sums the plurality of sound signals with the respective delays added thereto;

a detecting device that detects a harmonic structure of sound included in the sound signal;

a determining device coupled to the adder and to the detecting device that determines a direction of a sound source; and a filter device that selectively passes predetermined frequency components based upon the detected harmonic structure of sound including the sound signal coming from the sound source in the direction determined by said determining device, wherein said determining device determines the direction of the sound source by comparing frequency response before delay-and-sum processing performed by said delay devices and said adder with frequency response after the delay-and-sum processing, only with respect to positions of overtones constituting one harmonic structure.

2. A microphone array signal processing apparatus according to claim 1, wherein said detecting device comprises an extracting section that extracts a fundamental pitch included in the sound signal, and said filter device selectively passes components of frequencies that are integral multiples of the extracted fundamental pitch in the sound signal output from said adder.

3. A microphone array signal processing apparatus according to claim 1, wherein said detecting device identifies a harmonic structure of a sound signal coming from one sound source based upon temporal changes in spectrums of the sound signals.

4. A microphone array signal processing apparatus according to claim 1, wherein said filter device comprises a high-pass filter that passes high frequency components of an output from said adder, a comb filter that passes predetermined frequency components based upon the harmonic structure, and an output device that sums an output from said high-pass filter and an output from said comb filter and outputs an adding result.

5. A microphone array system comprising:

a microphone array comprising a plurality of spatially-arranged microphones; and a microphone array signal processing apparatus comprising:

delay devices that add delays to respective ones of a plurality of sound signals output from respective ones of a plurality of microphones constituting a microphone array;

an adder that sums the plurality of sound signals with the respective delays added thereto;

a detecting device that detects a harmonic structure of sound included in the sound signal;

a determining device coupled to the adder and to the detecting device that determines a direction of a sound source; and a filter device that selectively passes predetermined frequency components based upon the detected harmonic structure of sound including the sound signal coming from the sound source in the direction determined by said determining device, wherein said determining device determines the direction of the sound source by comparing frequency response before delay-and-sum processing performed by said delay devices and said adder with frequency response after the delay-and-sum processing, only with respect to positions of overtones constituting one harmonic structure.

6. A method of processing sound signals from a plurality of spatially-arranged microphones defining a microphone array, comprising the steps of:

receiving a plurality of sound signals from said microphones;

adding delays to respective ones of said plurality of sound signals;

summing the plurality of sound signals with the respective delays added thereto;

detecting a harmonic structure of sound included in the summed plurality of sound signals;

determining direction of a sound source based on the steps of summing and detecting; and filtering the summed sound signals by selectively passing predetermined frequency components based upon the detected harmonic structure of sound in the determined direction, wherein the determining step determines the direction of the sound source by comparing frequency response before delay-and-sum processing performed by delay devices and an adder with frequency response after the delay-and-sum processing, only with respect to positions of overtones constituting one harmonic structure.

* * * * *